US006102569A

United States Patent [19]

Wang

[11] Patent Number: 6,102,569

[45] Date of Patent: Aug. 15, 2000

[54] FOLDING COLLAPSIBLE STORAGE BOX

[76] Inventor: Wen-Tsan Wang, P.O. Box 82-144, Taipei, Taiwan

[21] Appl. No.: 09/408,128

[22] Filed: Sep. 29, 1999

[51] Int. Cl.[7] ..... B65D 30/16

[52] U.S. Cl. ..... 383/104; 383/13; 383/16; 383/97; 383/121.1; 220/9.2

[58] Field of Search ..... 383/13, 104, 119, 383/120, 121.1, 97, 16, 127; 220/9.1, 9.2, 9.3

[56] References Cited

U.S. PATENT DOCUMENTS

| | | | |
|---|---|---|---|
| 400,588 | 4/1889 | Meyering et al. | 220/9.2 X |
| 2,016,520 | 10/1935 | Short | 220/9.2 X |
| 2,150,620 | 3/1939 | Frost | 220/9.2 |
| 3,319,684 | 5/1967 | Calhoun | 383/13 X |
| 4,290,468 | 9/1981 | Rosenbloom, Jr. et al. | 220/9.1 |
| 5,048,977 | 9/1991 | Robbins, III | 383/104 |
| 5,964,533 | 10/1999 | Ziglar | 220/9.3 X |

FOREIGN PATENT DOCUMENTS

| | | | |
|---|---|---|---|
| 15181 | 8/1913 | United Kingdom | 220/9.2 |

*Primary Examiner*—Jes F. Pascua
*Attorney, Agent, or Firm*—A & J

[57] ABSTRACT

A folding collapsible storage box, which includes a fabric box body having rectangular horizontal top and bottom sides and four rectangular vertical peripheral sides, four horizontal rods respectively fastened to the box body along the border of the rectangular horizontal top side, four vertical rods respectively fastened to the box body and arranged between each two adjacent rectangular vertical peripheral sides, and a hard bottom board mounted inside the box body at the bottom, wherein the rectangular horizontal top side of the box body is formed of a rectangular top panel and a zip fastener, the rectangular top panel having one side formed integral with the box body, and three other sides separably connected to the box body by the zip fastener; hanging straps are detachably fastened to the box body by turn-locks at the rectangular vertical peripheral sides of the box body for hanging.

3 Claims, 5 Drawing Sheets

FOLDING COLLAPSIBLE STORAGE BOX

BACKGROUND OF THE INVENTION

The present invention relates to a folding collapsible storage box, and more particularly to such a folding collapsible storage box, which has a simple structure, and can easily be collapsed into a flat condition.

There is known a folding collapsible storage box according to the prior art, which comprises a rectangular fabric box body, the box body having a diagonally crossed folding line at each of four vertical peripheral panels thereof, four horizontal top rods respectively fastened to the box body at the top and arranged in horizontal at four sides, four horizontal bottom rods respectively fastened to the box body at the bottom and arranged in horizontal at four sides, four vertical rods respectively fastened to the box body and arranged in vertical in four corners, four sets of triangular blocks respectively fastened to the vertical peripheral panels of the box body, each set of triangular blocks including four triangular blocks fastened to one vertical peripheral panel of the box body and separated from one another by the diagonally crossed folding line at the corresponding vertical peripheral panel. This structure of folding collapsible storage box can be collapsed into a flat condition when not in use. However, the complicated structure of the folding collapsible storage box makes its manufacturing cost high. Another drawback of this structure of folding collapsible storage box is that the box body is an open box, having no cover means to cover its top open side. Furthermore, when several folding collapsible storage boxes are used, they cannot be arranged in a string for hanging on a high place.

SUMMARY OF THE INVENTION

It is one object of the present invention to provide a folding collapsible storage box, which can be conveniently closed to keep the storage items from sight. It is another object of the present invention to provide a folding collapsible storage box, which can easily be collapsed into a flat condition simply by twisting the top of the box body. It is still another object of the present invention to provide a folding collapsible storage box, which has means for hanging on a high place. It is still another object of the present invention to provide a folding collapsible storage box, which enables a number of folding collapsible storage boxes to be connected in a string and hung on a high place. To achieve these and other objects of the present invention, there is provided a folding collapsible storage box, which comprises a fabric box body having rectangular horizontal top and bottom sides and four rectangular vertical peripheral sides, four horizontal rods respectively fastened to the box body along the border of the rectangular horizontal top side, four vertical rods respectively fastened to the box body and arranged between each two adjacent rectangular vertical peripheral sides, and a hard bottom board mounted inside the box body at the bottom. The rectangular horizontal top side of the box body is formed of a rectangular top panel and a zip fastener, the rectangular top panel having one side formed integral with the box body, and three other sides separably connected to the box body by the zip fastener. The box body has turn locks at two opposite vertical peripheral sides thereof. Hanging straps are detachably fastened to the turn-locks at the box body for hanging.

DETAILED DESCRIPTION OF THE PREFERRED EMBODIMENT

Figure 1:
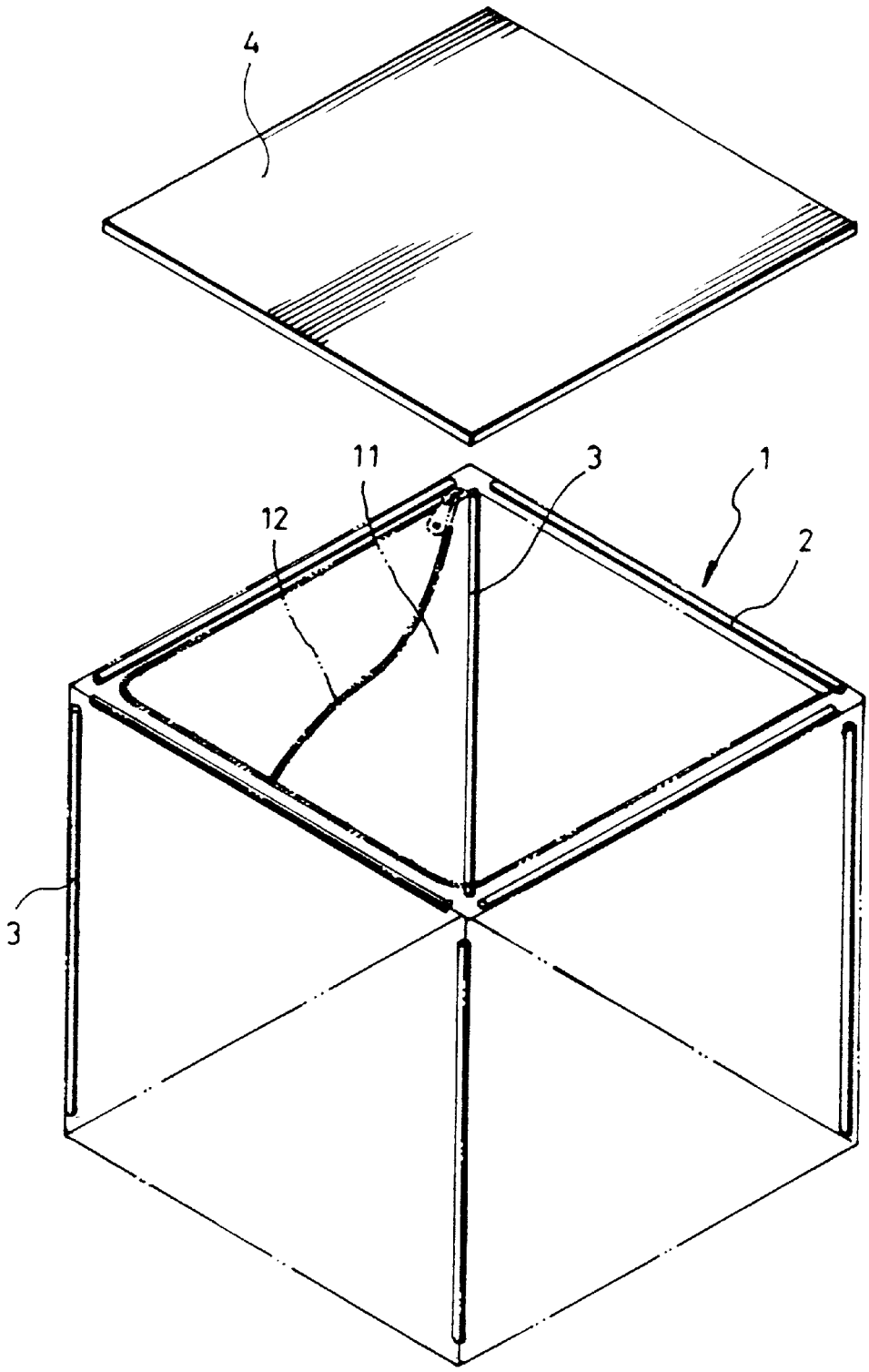
FIG. 1 is an exploded view of a folding collapsible storage box according to the present invention, showing the zip fastener unfastened, the rectangular top panel collapsed.

Referring to Figures from 1 through 4, a folding collapsible storage box in accordance with the present invention is comprised of a box body 1, four horizontal rods 2, four vertical rods 3, and a hard bottom plate 4. The box body 1 is made of fabric, for example, canvass, having a horizontal top side, a horizontal bottom side, four vertical peripheral sides connected between the horizontal top side and the horizontal bottom side. The top side of the box body 1 is formed of a rectangular top panel 11 and a zip fastener 12. The rectangular top panel 11 has one side formed integral with the box body 1, and the other three sides separably connected to the box body 1 by the zip fastener 12. When the zip fastener 12 is unfastened, the top panel 11 is collapsed, and an opening is shown at the top side of the box body 1. The four horizontal rods 2 are respectively fastened to the box body 1 and wrapped in the fabric of the box body 1, and horizontally arranged along the topmost edge of each of the four vertical peripheral sides of the box body 1. The horizontal rods 2 are slightly shorter than the width of each of the vertical peripheral sides of the box body 1. The four vertical rods 3 are respectively fastened to the box body 1, and wrapped in the fabric of the box body 1 along the connecting area between each two adjacent vertical peripheral sides of the body box 1. The length of the vertical rods 3 is slightly shorter than the height of the vertical peripheral sides of the box body 1. After installation of the horizontal rods 2 and the vertical rods 3, the rods 2 and 3 are prohibited from touching one another.

Figure 2:
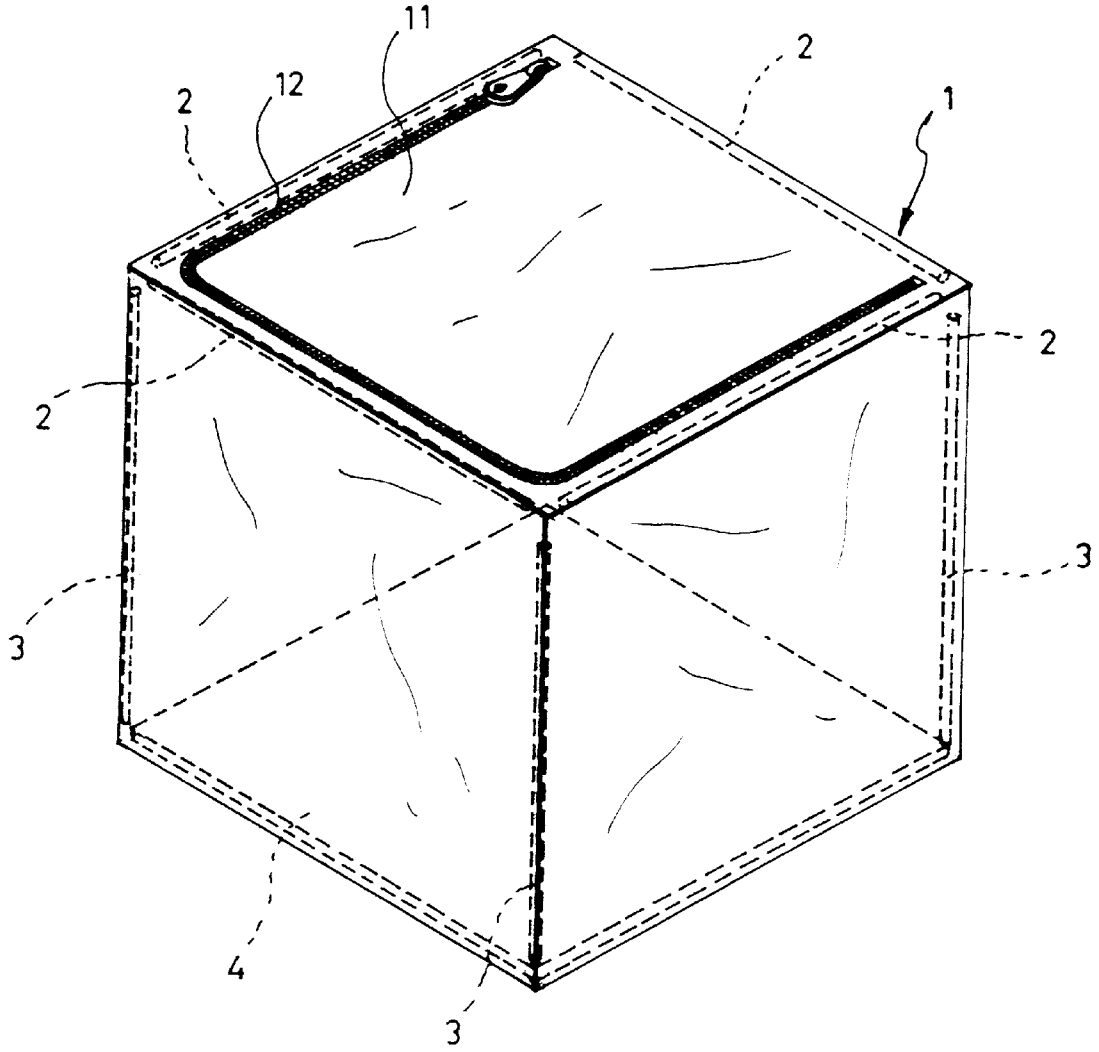
FIG. 2 is a perspective view of the present invention.

Referring to FIGS. 1 and 2 again, after installation of the rods 2 and 3 in the box body 1, the box body 1 is stretched out and supported in shape by the vertical rods 3, then the hard bottom board 4 is put inside the box body 1 and stopped below the vertical rods 3. When storage items are put in the box body 1, the zip fastener 12 is fastened up to close the top panel 11.

Figure 3:
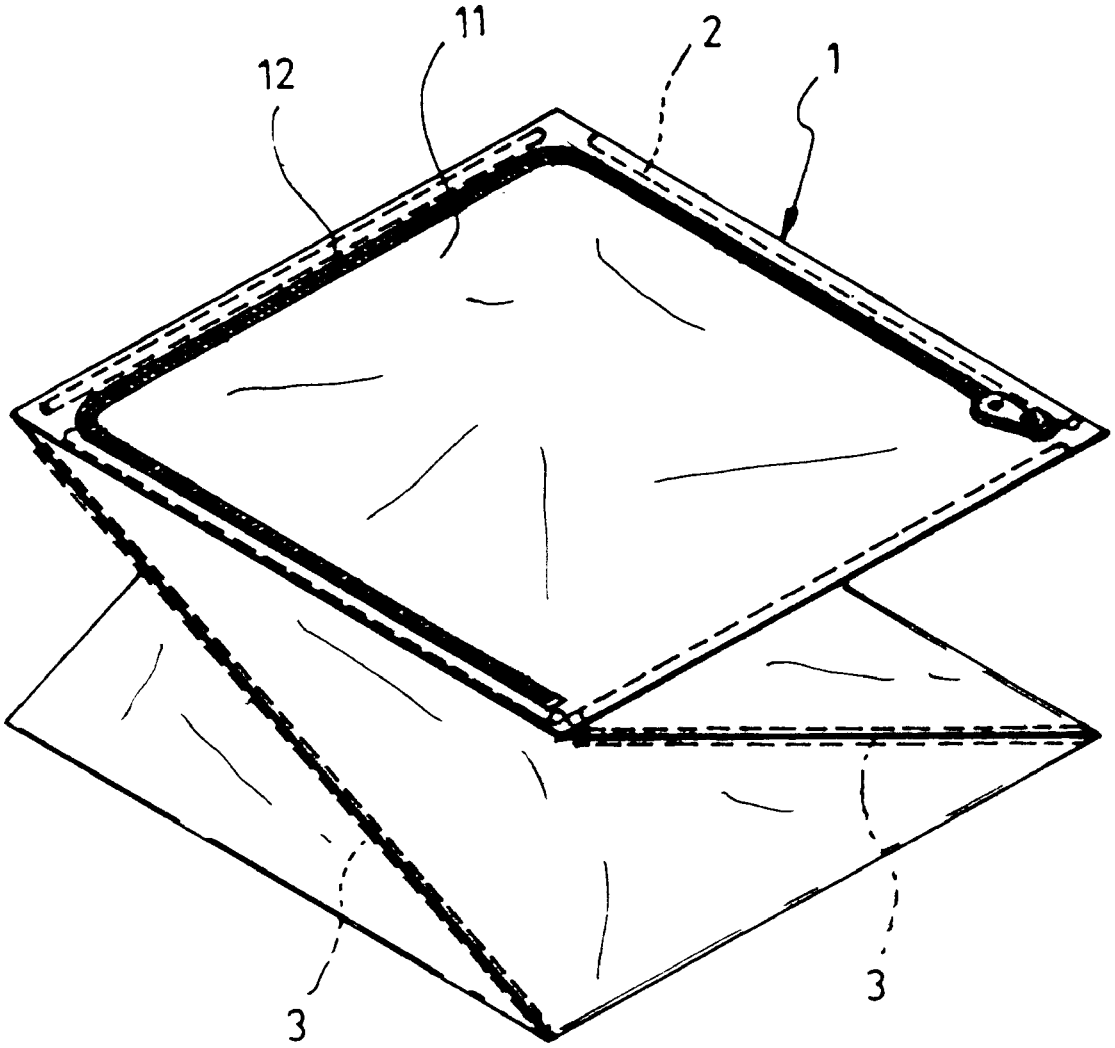
FIG. 3 shows the folding collapsible storage box twisted, the vertical peripheral sides of the box body folded up and lowered according to the present invention.
Figure 4:
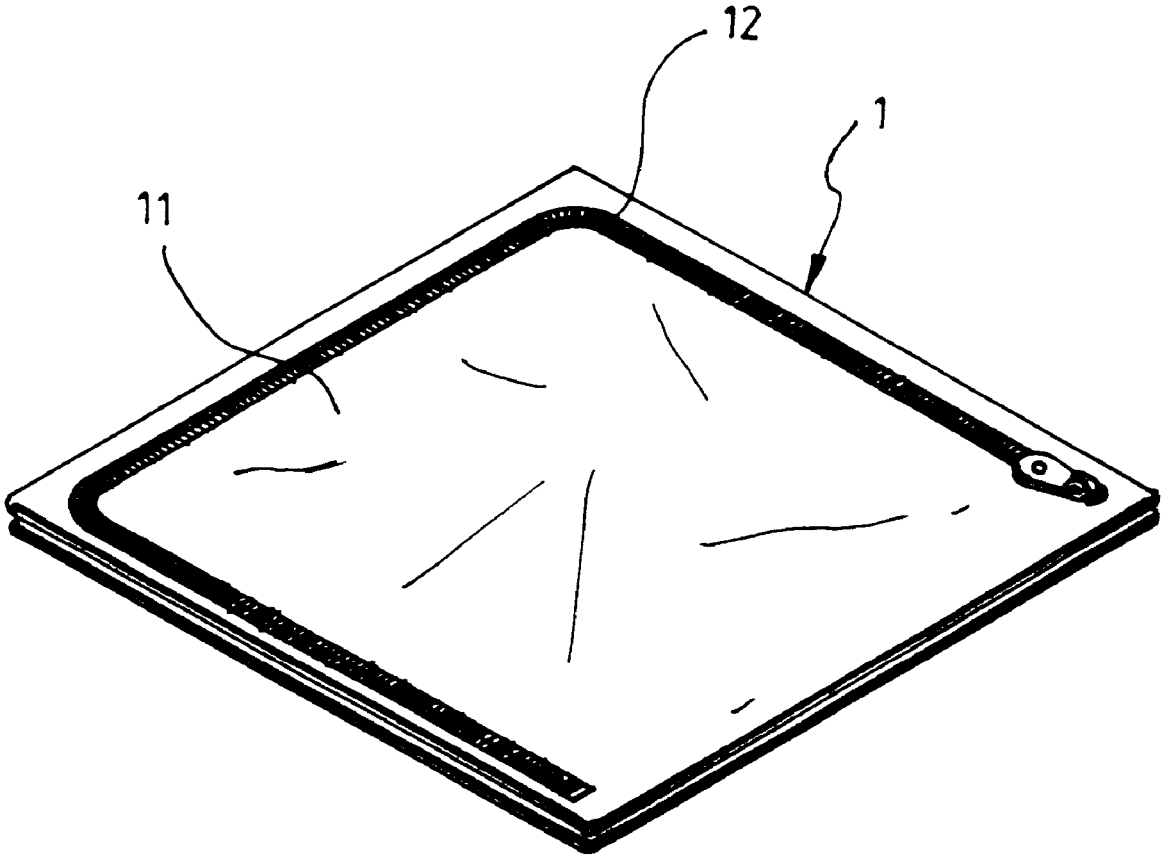
FIG. 4 shows the folding collapsible storage box fully collapsed.

Referring to FIGS. 3 and 4, when not in use, the top side of the box body 1 is twisted by hand through 90°, causing the four vertical peripheral sides of the box body 1 to be lowered and folded up (see FIG. 3), and therefore the storage box is collapsed into a flat condition (see FIG. 4).

Figure 5:
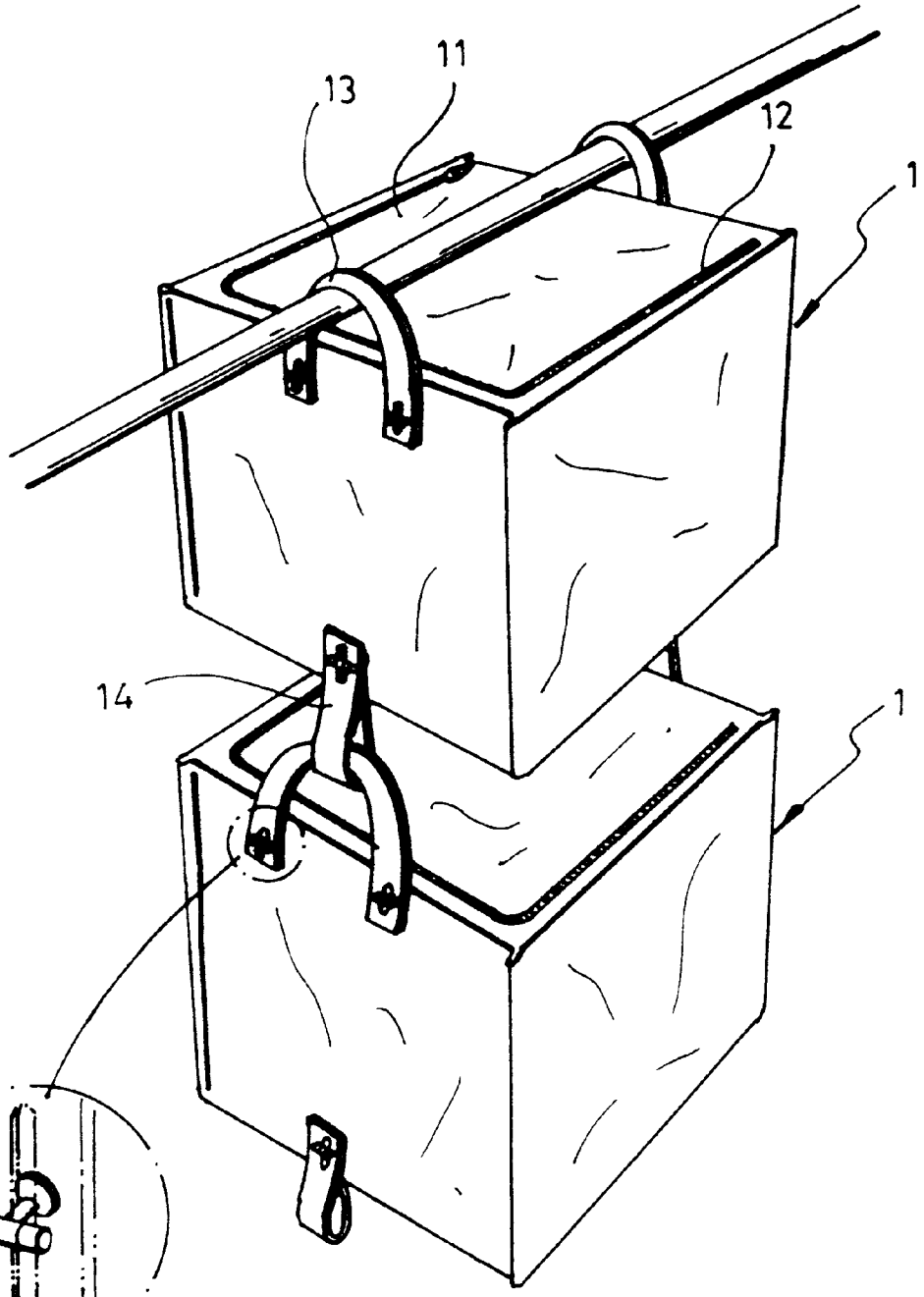
FIG. 5 shows an alternate form of the present invention.
Figure 5A:
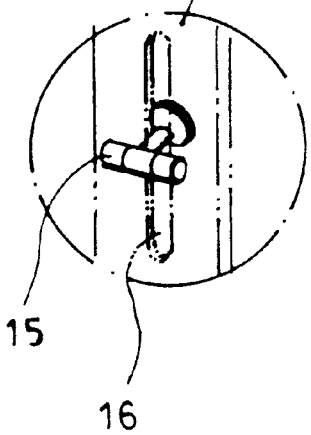
FIG. 5A is an enlarged view of a part of FIG. 5.

Referring to FIGS. 5 and 5A, two first hanging straps 13 and two second hanging straps 14 are respectively provided two opposite vertical peripheral sides of the box body 1 at different elevations. The first hanging straps 13 each have two elongated mounting slots 16 respectively provided at two distal ends, and detachably coupled to a respective turn-lock 15 at the box body 1. The second hanging straps 14 each have one end (the fixed end) fixedly fastened to the box body 1 by stitches, and an opposite end (the free end provided with an elongated mounting slot 16 and detachably connected to a respective turn-lock 15 at the box body 1. By means of the first hanging straps 13 and the second hanging strips 14, a plurality of folding collapsible storage boxes can be arranged in a string and hung on a rod.

It is to be understood that the drawings are designed for purposes of illustration only, and are not intended for use as a definition of the limits and scope of the invention disclosed.

What the invention claimed is:

1. A folding collapsible storage box comprising:

a fabric box body, said fabric box body comprising a rectangular horizontal top side, a rectangular horizontal bottom side, and four rectangular vertical peripheral sides connected to one another between said rectangular horizontal top side and said rectangular horizontal bottom side along the border of said rectangular horizontal bottom side and said rectangular horizontal top side;

four horizontal rods respectively fastened to said rectangular vertical peripheral sides of said fabric box body and arranged along said rectangular open top side of said fabric box body;

four vertical rods respectively fastened to said rectangular vertical peripheral sides of said fabric box body, and arranged between each two adjacent rectangular vertical peripheral sides of said fabric box body; and a hard bottom board mounted inside said box body and supported on said rectangular horizontal bottom side of said box body;

wherein the rectangular horizontal top side of said box body is formed of a rectangular top panel and a zip fastener, said rectangular top panel having one side formed integral with said box body, and three other sides separably connected to said box body by said zip fastener; said vertical rods and said horizontal rods support said box body in shape, and enable said box body to be collapsed into a flat condition by twisting the rectangular horizontal top side of said box body.

2. The folding collapsible storage box of claim 1 wherein said box body comprises two pairs of turn-locks symmetrically disposed at two opposite vertical peripheral sides near said rectangular horizontal top side, and two hanging straps respectively and detachably fastened to the turn-locks, said hanging straps each having two elongated mounting slots at two distal ends for coupling to said turn-locks.

3. The folding collapsible storage box of claim 2 wherein said box body comprises two second hanging straps respectively provided at two opposite vertical peripheral sides near said rectangular horizontal bottom side, said second hanging straps each having a first end fixedly fastened to said vertical peripheral sides by stitches and a second end made with an elongated mounting slot detachably fastened to a respective turn-lock at said rectangular vertical peripheral sides of said box body.

* * * * *